US010276112B2

(12) United States Patent
Zhang

(10) Patent No.: US 10,276,112 B2
(45) Date of Patent: Apr. 30, 2019

(54) MURA PHENOMENON COMPENSATION METHOD OF DISPLAY PANEL AND DISPLAY PANEL

(71) Applicant: Shenzhen China Star Optoelectronics Technology Co., Ltd., Shenzhen, Guangdong (CN)

(72) Inventor: Hua Zhang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 15/552,273

(22) PCT Filed: May 10, 2017

(86) PCT No.: PCT/CN2017/083823

§ 371 (c)(1),
(2) Date: Aug. 19, 2017

(87) PCT Pub. No.: WO2018/201512

PCT Pub. Date: Nov. 8, 2018

(65) Prior Publication Data

US 2018/0330682 A1 Nov. 15, 2018

(51) Int. Cl.

| | |
|---|---|
| ***G09G 3/22*** | (2006.01) |
| ***G09G 3/36*** | (2006.01) |
| ***G09G 3/00*** | (2006.01) |

(52) U.S. Cl.

CPC ..... *G09G 3/3611* (2013.01); *G09G 3/006* (2013.01); *G09G 3/22* (2013.01); *G09G 2320/0233* (2013.01)

(58) Field of Classification Search

CPC ..... G09G 3/006; H04N 19/124; G02F 1/133

See application file for complete search history.

(56) References Cited

U.S. PATENT DOCUMENTS

| | | | | |
|---|---|---|---|---|
| 9,576,541 | B2 | 2/2017 | Chung et al. | |
| 2008/0284794 | A1 | 11/2008 | Wang et al. | |
| 2009/0135211 | A1 | 5/2009 | Wang et al. | |
| 2014/0184671 | A1* | 7/2014 | Lee | G09G 3/006 345/697 |

(Continued)

FOREIGN PATENT DOCUMENTS

| | | | |
|---|---|---|---|
| CN | 104992657 | A | 10/2015 |
| CN | 105206239 | A | 12/2015 |

(Continued)

*Primary Examiner* — Abdul-Samad A Adediran
(74) *Attorney, Agent, or Firm* — Andrew C. Cheng

(57) ABSTRACT

The embodiment of the present invention discloses a mura phenomenon compensation method of a display panel, comprising steps of: implementing compression for a region of n*m pixels to store a mura compensation value corresponding to a center pixel of each region, wherein the mura compensation value of the center pixel of at least one region is an average mura compensation value of a corresponding region, and n and m are integers larger than or equal to 2; obtaining mura compensation values corresponding to other pixels except the center pixel according to the stored mura compensation value. The embodiment of the present invention further discloses a display panel. The present invention possesses the advantages of saving storage space.

6 Claims, 5 Drawing Sheets

(56) References Cited

U.S. PATENT DOCUMENTS

| | | | | |
|---|---|---|---|---|
| 2017/0332090 | A1* | 11/2017 | Furihata | H04N 19/124 |
| 2018/0204528 | A1* | 7/2018 | Miyazawa | G02F 1/133 |

FOREIGN PATENT DOCUMENTS

| | | | |
|---|---|---|---|
| CN | 105590604 | A | 5/2016 |
| CN | 105632443 | A | 6/2016 |
| CN | 105895043 | A | 8/2016 |

* cited by examiner

MURA PHENOMENON COMPENSATION METHOD OF DISPLAY PANEL AND DISPLAY PANEL

CROSS REFERENCE

This application claims the priority of Chinese Patent Application No. 201710305591.7, entitled "Mura phenomenon compensation method of display panel and display panel", filed on May 3, 2017, the disclosure of which is incorporated herein by reference in its entirety.

FIELD OF THE INVENTION

The present invention relates to a display technology field, and more particularly to a mura phenomenon compensation method of a display panel and the display panel.

BACKGROUND OF THE INVENTION

Due to the defects in the liquid crystal display (Liquid Crystal Display, LCD) process, it often leads to the uneven brightness of the produced liquid crystal display panel to form a variety of mura (mura refers to the uneven brightness of the display, resulting in phenomenon of various marks).

For promoting the uniformity of the display panel brightness, there are mura compensation methods at present, i.e. capturing the gray scale screen (the white screens of different brightnesses) with the external camera, and comparing with the brightness of the center position of the display panel to calculate the differences between the brightnesses of the surrounding region and the center position, and then, reversely compensating the gray scales (reducing the gray scale for the region which is brighter than the center position for reducing the brightness; raising the gray scale for the region which is darker than the center position for raising the brightness) of the mura positions to enable the display panel as a whole have a relatively uniform brightness.

The general reverse compensation data is stored in the data memory (flash). Meanwhile, in order to reduce the design cost, the data memory does not store the gray-level compensation data for each pixel. The general practice is to implement compression for regions of n*n pixels (such as 8*8 pixels). Typically, the gray scale compensation data for one pixel is stored in the data memory for each region. The gray scale compensation data of other pixels in the region is calculated by linear interpolation.

The display panel (3840*2160 pixels UHD, representing regions of 3840 pixels and 2160 pixels) of (Ultra High Definition) resolution is described as an example. Please refer to FIG. 1. The compression is implemented for 8*8 pixels to form 480*270 regions (the square dotted line in figure forms one region). The data memory stores the mura compensation data corresponding to the pixels (marked with circles) at the intersection positions of the 1st row of pixels, the 9th row of pixels, the 17th row of pixels, . . . , the 2145th row of pixels, and the 2153th row of pixels with the 1st column of pixels, the 9th column of pixels, the 17th column of pixels, . . . , the 3825th column of pixels, and the 3833th column of pixels, which includes 480*270 mura compensation data. Besides, for calculating and obtaining the mura compensation data corresponding to the 3834th column to the 3840th column of pixels and calculating the mura compensation data corresponding to the 2154th row to the 2160th row of pixels, the mura compensation data corresponding to the 3841th column of the pixel (the virtual pixels marked in the circles) is calculated and obtained with the stored mura compensation data corresponding to the 3825th column of pixels and the stored mura compensation data corresponding to the 3833th column of pixels to have 270 mura compensation data. The mura compensation data corresponding to the 2161th row of the pixel (the virtual pixels marked in the circles) is calculated and obtained with the stored mura compensation data corresponding to the 2145th row of pixels and the stored mura compensation data corresponding to the 2153th row of pixels to have 480 mura compensation data. Accordingly, the data memory needs to store a total of 481*271 mura compensation data. The mura compensation data of the other pixels is calculated and obtained by the linear interpolation of the sequence controller (Tcon IC) according to the present 481*271 mura compensation data.

The specific calculations of the other pixels are as follows, and please continue referring to FIG. 1. The region formed by 8*8 pixels of the 1st column to the 8th column is illustrated for explanation. In this region, as known, the mura compensation value corresponding to the pixel at the intersection of the 1st column of pixels and the 1st row of pixels is A', and the mura compensation value corresponding to the pixel at the intersection of the 9st column of pixels and the 1st row of pixels is B', and the mura compensation value corresponding to the pixel at the intersection of the 1st column of pixels and the 9st row of pixels is C', and the mura compensation value corresponding to the pixel at the intersection of the 9st column of pixels and the 9st row of pixels is D', and the mura compensation value corresponding to the pixel e' is E', and the mura compensation value corresponding to the pixel f' is F', and the mura compensation value corresponding to the pixel g' is G', and E', F' and G' are calculated by linear interpolation as follows:

$$E'=[(8-Y')*A'+Y'*C']/8;$$

$$F'=[(8-Y')*B'+Y'*D']/8;$$

$$G'=[(8-X')*E'+X'*F']/8.$$

X' and Y' are the row number and the column number of the corresponding pixel relative to the pixel at the crossing position of the first column and the first row.

With further reference to the above calculation method, the mura compensation data calculation of the 3834th column to the 3840th column of pixels and the 2154th row to the 2160th row of pixels requires the mura compensation data corresponding to the 3841th column of pixels and the 2161th row of pixels. Therefore, 481*271 mura compensation data need to be stored. Because the data memory needs storing 481*271 mura compensation data, the amount of data stored is larger, resulting in that the data storage space of the data memory needs to be larger, thus increasing the cost.

SUMMARY OF THE INVENTION

The technical issue that the embodiment of the present invention solves is to provide a mura phenomenon compensation method of a display panel and the display panel. The present application can reduce the display panel storage space.

For solving the aforesaid technical issue, the present invention first provides a mura phenomenon compensation method of a display panel, comprising:

implementing compression for a region of n*m pixels to store a mura compensation value corresponding to a center pixel of each region, wherein the mura compensation value of the center pixel of at least one region is an average mura compensation value of a corresponding region, and n and m are integers larger than or equal to 2;

obtaining mura compensation values corresponding to other pixels except the center pixel according to the stored mura compensation value.

The mura compensation value corresponding to the center pixel of each region is the average mura compensation value of the corresponding region.

The step of obtaining mura compensation values corresponding to the other pixels except the center pixel according to the stored mura compensation value comprises:

determining whether the other pixels are located outside a row or a column, where an outermost center pixel of the display panel is located;

if yes, taking the mura compensation value corresponding to the center pixel of the region, where the other pixels are located as the mura compensation values corresponding to the other pixels.

The method further comprises steps of:

if no, obtaining the mura compensation values corresponding to the other pixels by linearly interpolating the mura compensation value corresponding to the center pixel of the region, where the other pixels are located and a mura compensation value corresponding to a center pixel of an adjacent region.

n=m.

The display panel comprises a plurality of special regions at edges, and the special regions comprises pixels of n*a or b*m, wherein a is less than m and a is a positive integer, and b is less than n and b is a positive integer, and the method further comprises steps of:

storing mura compensation values corresponding to center pixels of the special regions, wherein the mura compensation values corresponding to the center pixels are average compensation values of the corresponding special regions;

obtaining mura compensation values corresponding to other pixels except the center pixels of the special regions according to the stored mura compensation values of the special regions.

A resolution of the display panel is 3840*2160, and n=m=8, and the display panel comprises 480*270 separate regions.

Second, the present invention provides a display panel, comprising:

a storage unit, implementing compression for a region of n*m pixels to store a mura compensation value corresponding to a center pixel of each region, wherein the mura compensation value of the center pixel of at least one region is an average mura compensation value of a corresponding region, and n and m are integers larger than or equal to 2;

a processing unit, obtaining mura compensation values corresponding to other pixels except the center pixel according to the stored mura compensation value.

The mura compensation value corresponding to the center pixel of each region is the average mura compensation value of the corresponding region.

wherein the processing unit comprises:

a determining unit, determining whether the other pixels are located outside a row or a column, where an outermost center pixel of the display panel is located;

a processing sub unit, if a determination of the determining unit is yes, taking the mura compensation value corresponding to the center pixel of the region, where the other pixels are located as the mura compensation values corresponding to the other pixels; if the determination of the determining unit is no, obtaining the mura compensation values corresponding to the other pixels by linearly interpolating the mura compensation value corresponding to the center pixel of the region, where the other pixels are located and a mura compensation value corresponding to a center pixel of an adjacent region.

With implementing the embodiments of the present invention, the benefits are: since the mura compensation values stored in the display panel are reduced relative to the prior art, the display panel storage space can be reduced, so that the cost can be reduced.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Embodiments of the present invention are described in detail with the technical matters, structural features, achieved objects, and effects with reference to the accompanying drawings as follows. It is clear that the described embodiments are part of embodiments of the present invention, but not all embodiments. Based on the embodiments of the present invention, all other embodiments to those of ordinary skill in the premise of no creative efforts obtained, should be considered within the scope of protection of the present invention.

Furthermore, the terms “including” and “having” and their any deformations are intended to cover non-exclusive inclusion. For example, a process, a method, a system, a product or a device comprising a series of steps or units which is not limited to the steps or units already listed, but optionally further comprises steps or units which are not listed, or optionally further comprises other steps or units which are inherent in these the process, the method, the product or the device. The terminologies “first”, “second”

and "third" are used for distinguishing different objects but not for describing the specific sequence.

Figure 2:
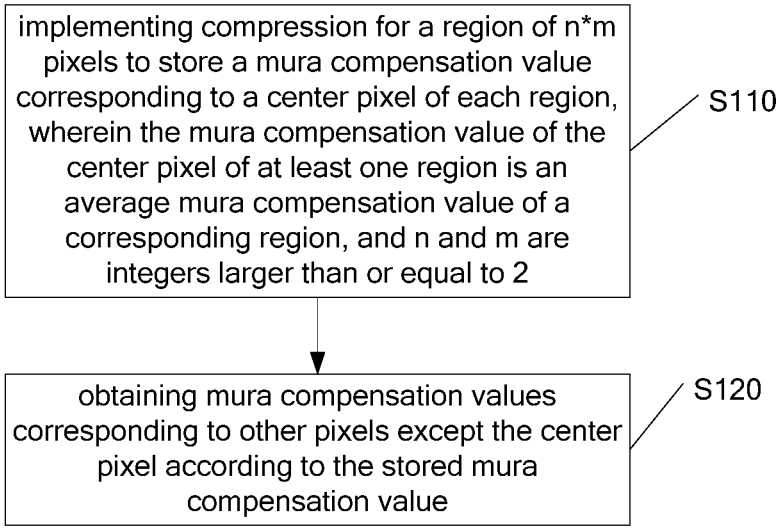
FIG. 2 is a flowchart of a mura phenomenon compensation method of a display panel according to one embodiment of the present invention.

The embodiment of the present invention provides a mura phenomenon compensation method of a display panel. The display panel may be a liquid crystal display panel or other display panel. In the following description, the display panel is described as an example of a UHD (Ultra High Definition) display panel. Namely, the resolution of the display panel reaches up to 3840*2160 (the resolution 3840*2160 is illustrated for the following description). Certainly, in other embodiments of the present invention, the resolution of the display panel is not limited to the aforesaid resolution but may also be 1920*1080 resolution or other resolutions. Please refer to FIG. 2 and FIG. 3. The method comprises steps of:

S110, implementing compression for a region of n*m pixels to store a mura compensation value corresponding to a center pixel of each region, wherein the mura compensation value of the center pixel of at least one region is an average mura compensation value of a corresponding region, and n and m are integers larger than or equal to 2;

In this embodiment, n=m, and n and m are both 8. Certainly, in other embodiments of the present invention, n and m may not be equal, and the n and m may also be other integers larger than or equal to 2.

Figure 3:
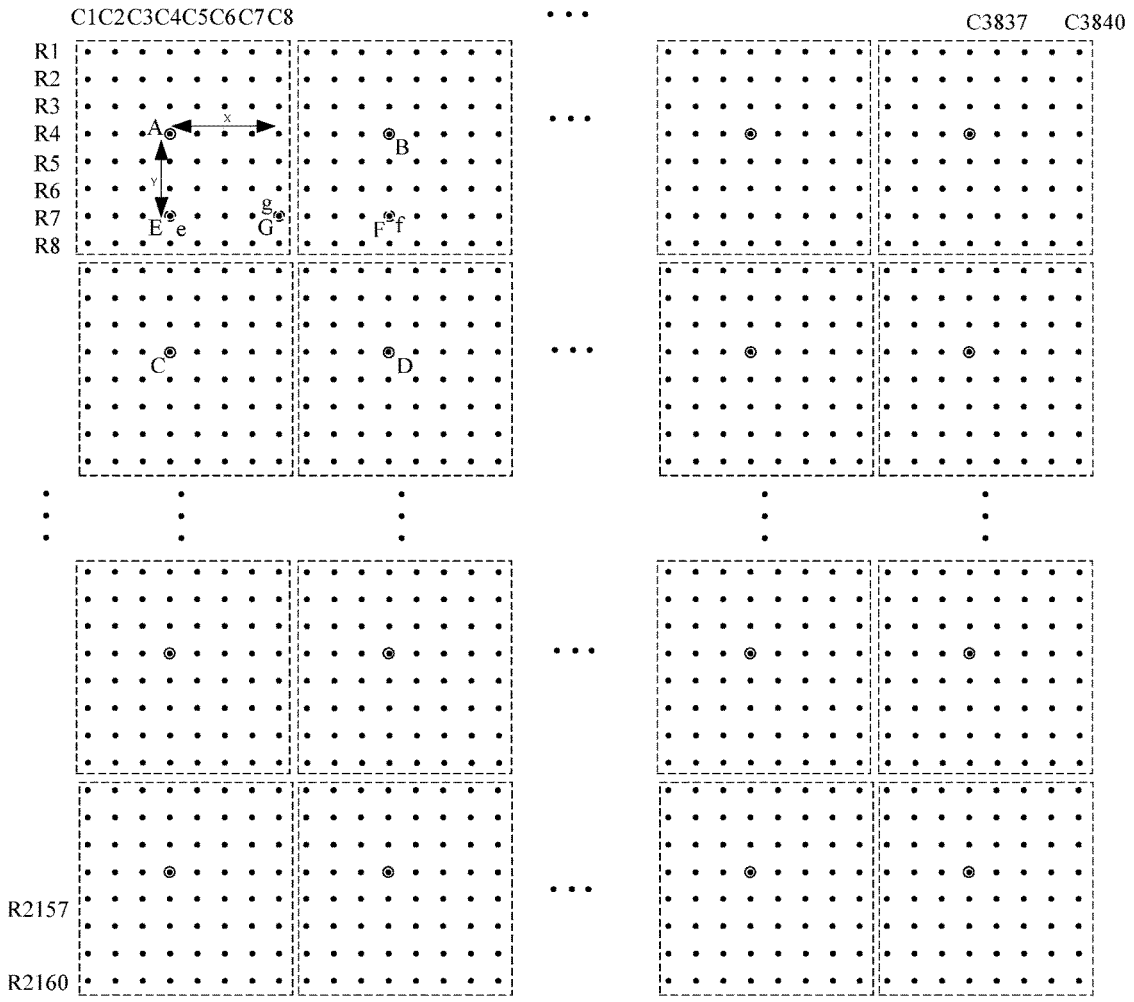
FIG. 3 is an arrangement diagram of pixels of a display panel according to one embodiment of the present invention (the display panel stores the mura compensation values of the pixels in the circles)

In this embodiment, the compression is implemented to the display panel by 8*8 pixels to form 480 (3840/8=480) *270 (2160/8=270) regions. Please refer to FIG. 3. In FIG. 3, one dashed box is one region. The display panel stores a mura compensation value corresponding to a center pixel (the center pixels in FIG. 3 are marked in circles) of each region. Because there are only 480*270 regions, the display panel only needs to store 480*270 mura compensation values. Please continue referring to FIG. 3. the region at the top left corner of the display panel is illustrated for explanation. The region is arranged with the first column of pixels C1 to the eighth column of pixels C8 and the first row of pixels R1 to the eighth row of pixels R8. The center pixel of the region can be the pixel at the intersection of the fourth row of pixels R4 and the fourth column of pixels C4, or can be the pixel at the intersection of the fourth row of pixels R4 and the fifth column of pixels C5, or can be the pixel at the intersection of the fifth row of pixels R5 and the fourth column of pixels C4, or can be the pixel at the intersection of the fifth row of pixels R5 and the fifth column of pixels C5. In this embodiment, the pixel at the intersection of the fourth row of pixels R4 and the fourth column of pixels C4 is the center pixel (marked in circle in FIG. 3). The settings of the center pixels in other regions of the display panel also refer to the center pixel position of this region. Certainly, in other embodiments of the present invention, when a center pixel is present in the region, the center pixel is the most central pixel.

In this embodiment, in the formed 480*270 regions, the mura compensation value of the center pixel of at least one region is an average mura compensation value of a corresponding region. For instance, the mura compensation value of the center pixel is a sum of the mura compensation values for all the pixels of the region divided by 64. In this embodiment, the mura compensation value corresponding to the center pixel of each region is the average mura compensation value of the corresponding region. The average mura compensation value is obtained by an external mura repair system and then correspondingly stored in the display panel. Certainly, in other embodiments of the present invention, the mura compensation value of the center pixel may also be the actual mura compensation value of the pixel, rather than the average mura compensation value of the corresponding region.

S120, obtaining mura compensation values corresponding to other pixels except the center pixel according to the stored mura compensation value.

In this embodiment, the pixels in the same region that the display panel is implemented with compression comprise a center pixel and other pixels. The mura compensation values corresponding to the other pixels can be obtained according to the stored 480*270 mura compensation values. As an illustration, the mura compensation values corresponding to the other pixels can be obtained by linear interpolation, or the mura compensation values corresponding to the other pixels of some special positions are directly given with the mura compensation value of the center pixel of the region. Then, the mura compensation value of the center pixel of the region is the average mura compensation value of the corresponding region.

The mura compensation values stored in the display panel are reduced relative to the prior art. Specifically, there are 480*270 mura compensation values stored in this embodiment. There are 481*271 values need to be stored in prior art. Thus, the storage space of the display panel can be reduced to decrease the cost.

Figure 4:
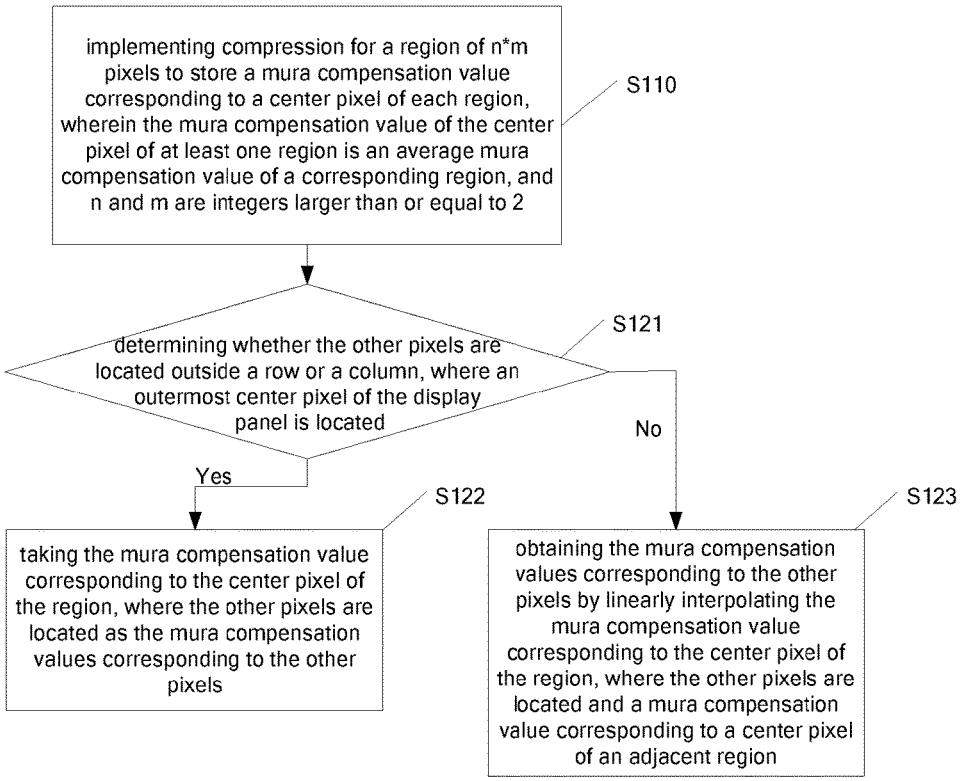
FIG. 4 is a flowchart of a mura phenomenon compensation method of a display panel according to another embodiment of the present invention.

Please refer to FIG. 4. Selectably, step S120 of obtaining mura compensation values corresponding to the other pixels except the center pixel according to the stored mura compensation value specifically comprises:

S121: determining whether the other pixels are located outside a row or a column, where an outermost center pixel of the display panel is located, and if yes, step S122 is executed, and if not, step S123 is executed.

In this embodiment, the display panel is square. The outermost sides of the display panel comprise a left side, a right side, an upper side and a lower side. The row or column, where the center pixel at the outermost side of the display panel is located, is column 4 in the left side, and is column 3836 in the right side, and is row 4 in upper side, and is row 2156 in the lower side. determining whether the other pixels are located in regions outside a row or a column, where an outermost center pixel of the display panel is located is to determine whether the other pixels are located in positions outside the region surrounded by the 4th column of pixels, the 3836th column of pixels, the 4th row of pixels, and the 2156th row of pixels. Namely, it is to determine whether the other pixels are located in the 1st column to the 3rd column of pixels, in the 3837th column to the 3840th column of pixels, in the 1st row to the 3rd row of pixels and in the 2157th row to the 2160th row of pixels of the display panel.

S122: taking the mura compensation value corresponding to the center pixel of the region, where the other pixels are located as the mura compensation values corresponding to the other pixels.

In this embodiment, if the other pixels are located in the 1st column to the 3rd column of pixels, in the 3837th column to the 3840th column of pixels, in the 1st row to the 3rd row of pixels and in the 2157th row to the 2160th row of pixels of the display panel, such as the coordinates of the other pixels are (1,1) (representing the pixels at the intersection of the first column of pixels and the first row of pixels, that is, the pixel at the top left), (1,2160) (representing the column coordinate and the row coordinate), (3840,1), (3840,2160), (3,4) and (4,3). Then, the mura compensation value corresponding to the center pixel of the region, where the other pixels are located, are taken as the mura compensation values corresponding to the other pixels. As an illustration, as the coordinate of the other pixel is (1,1), the mura compensation value corresponding to the center pixel of the region at the top left is given as the mura compensation value corresponding to the pixel with the coordinate (1,1). Namely, the mura compensation value corresponding to the center pixel with the coordinate (4,4) is given as the mura compensation value corresponding to the pixel with the coordinate (1,1).

Figure 1:
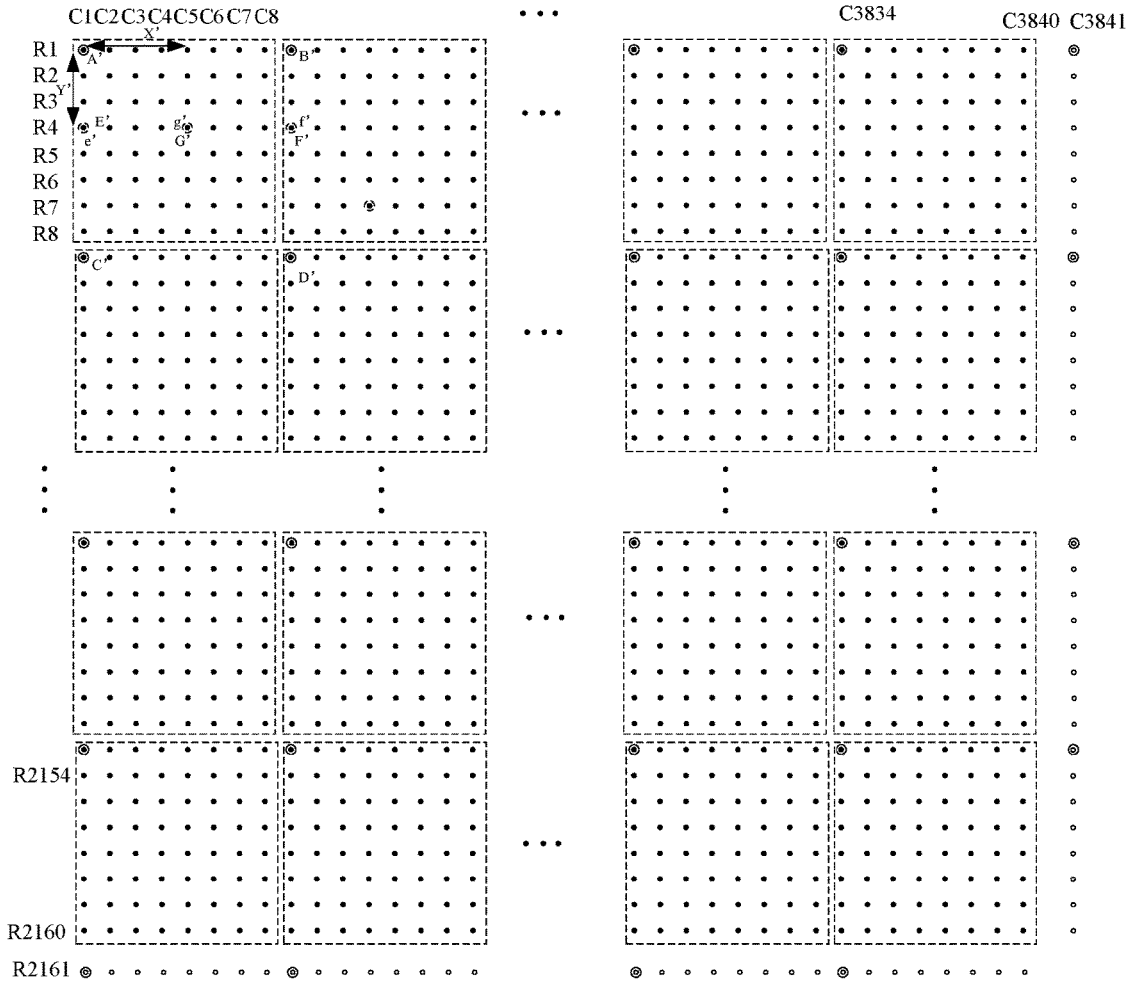
FIG. 1 is an arrangement diagram of pixels of a display panel according to prior art (the display panel stores the mura compensation values of the pixels in the circles)
Figure 5:
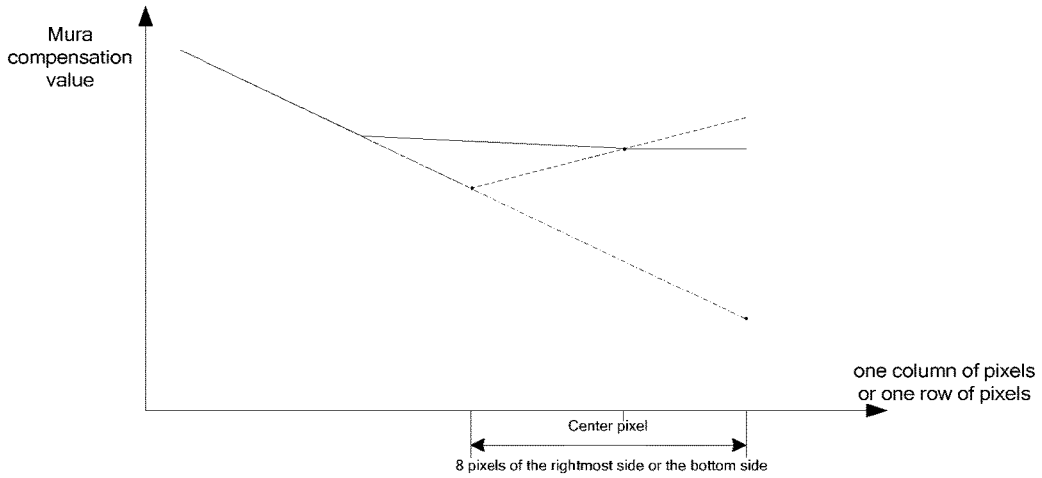
FIG. 5 is a comparison diagram of a mura compensation line (solid line) for one row/column of pixels according to the another embodiment of the present invention, a mura compensation line (dot dash line) for one row/column of pixels according to prior art and a mura compensation line (dotted line) actually required for one row/column of pixels.

In this embodiment, since the mura compensation value corresponding to the center pixel is the average mura compensation value of the corresponding region, thus taking the mura compensation value as the mura compensation values corresponding to the other pixels will not cause the uneven brightness. Unlike prior art (referring to FIG. 1) that obtaining the mura compensation data of the 3834th column to the 3840th column of pixels and the 2154th row to the 2160th row of pixels needs the mura compensation data corresponding to the 3841th of pixels and the 2161th row of pixels (the pixels marked in circles). Because the mura compensation data of the 3841th of pixels and the 2161th row of pixels (the pixels marked in circles) themselves are not accurate (these pixels are virtual pixels, which are obtained by calculation), the calculated mura compensation data for the other pixels at the 3834th column to the 3840th column of pixels and the 2154th row to the 2160th row of pixels are more inaccurate to result in the uneven brightness issue. Please refer to FIG. 5. The mura compensation result of this embodiment is better and is more close to the mura compensation value which is actually required to promote the screen effect of the display panel. Moreover, since the pixels except the row or column, where the center pixel of the outermost side of the display panel is located, are processed in this manner, the display panel does not have to store some of the compensation data as much as in the prior art. Besides, in other embodiments of the present invention, the display panel may also be subjected to other processes, and it is also possible not to store some of the compensation data as much as in the prior art. For instance, the other pixels can be covered by a side frame. Besides, because the four edges may easily have light leakage after the module is assembled in prior art, which will also influence the calculation accuracy of the mura compensation data of pixels of the first row and the first column. In this embodiment, the compensation values of the pixels at the edges of the display panel are directly given with the average mura compensation values of the corresponding regions, so the brightness at the edges is more even.

S123: obtaining the mura compensation values corresponding to the other pixels by linearly interpolating the mura compensation value corresponding to the center pixel of the region, where the other pixels are located and a mura compensation value corresponding to a center pixel of an adjacent region.

In this embodiment, if the other pixels are not located in the 1st column to the 3rd column of pixels, in the 3837th column to the 3840th column of pixels, in the 1st row to the 3rd row of pixels and in the 2157th row to the 2160th row of pixels of the display panel, i.e. the other pixels are located in the region surrounded by the 4th column to the 3836th column of pixels and the 4th row to the 2156th row of pixels, the mura compensation values corresponding to the other pixels are obtained by linearly interpolating the mura compensation value corresponding to the center pixel of the region, where the other pixels are located and a mura compensation value corresponding to a center pixel of an adjacent region.

Please continue referring to FIG. 3. The e pixel, the g pixel, and the f pixel in the figure are illustrated for calculating the mura compensation values E, G, F corresponding thereto and the mura compensation values E, G and F are as follows:

$$E=[(8-Y)*A+Y*C]/8;$$

$$F=[(8-Y)*B+Y*D]/8;$$

$$G=[(8-X)*E+X*F]/8.$$

X and Y are the row number and the column number of the corresponding pixel relative to the center pixel (4, 4), respectively.

Similarly, the mura compensation values corresponding to the other pixels, which are not located in the 1st column to the 3rd column of pixels, in the 3837th column to the 3840th column of pixels, in the 1st row to the 3rd row of pixels and in the 2157th row to the 2160th row of pixels of the display panel can be obtained by linear interpolation, thus the mura compensation values corresponding to the pixels in the entire display panel can be obtained.

Figure 6:
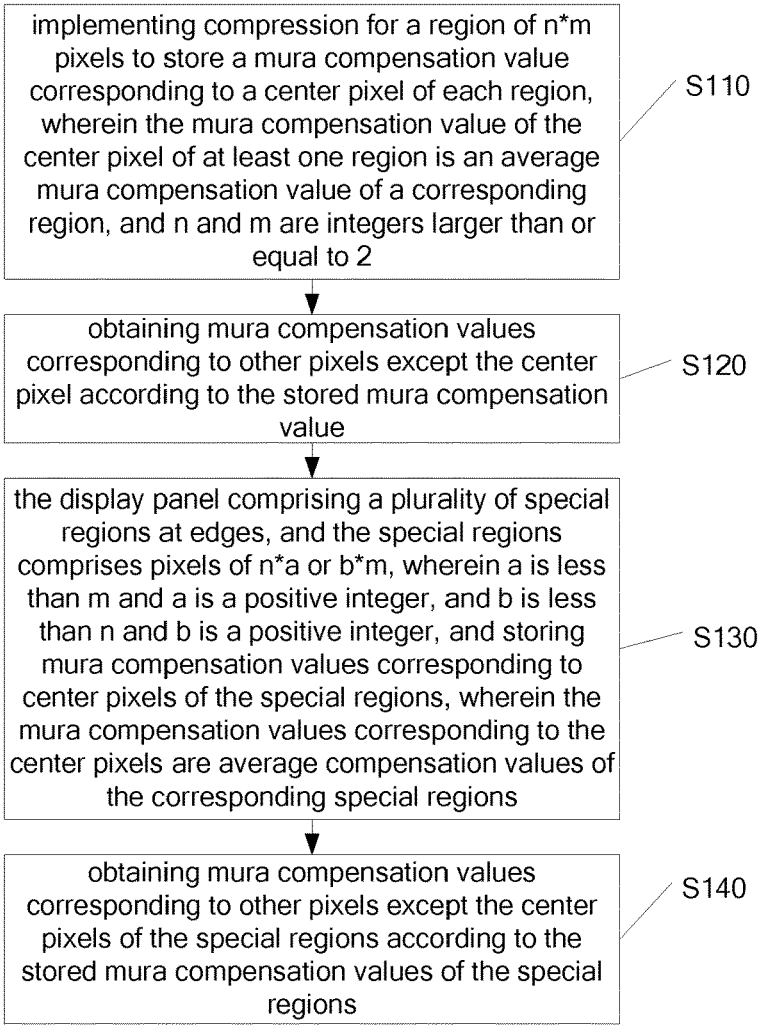
FIG. 6 is a flowchart of a mura phenomenon compensation method of a display panel according to one another embodiment of the present invention.

Besides, in other embodiments of the present invention, as the display panel resolution cannot be divisible for n or m, the display panel comprises a plurality of special regions at edges, and the special regions comprises pixels of n*a or b*m, wherein a is less than m and a is a positive integer, and b is less than n and b is a positive integer. For implementing mura compensation to these regions, referring to FIG. 6, the mura phenomenon compensation method of the display panel further comprises except step 110, and step S120:

S130: storing mura compensation values corresponding to center pixels of the special regions, wherein the mura compensation values corresponding to the center pixels are average compensation values of the corresponding special regions;

For example, as the pixels included in the special region is 8*5, the coordinate of the center pixel can be (4,3) or (5,3), i.e the pixel at the intersect of the 4th column of pixels and the 3rd row of pixels or the pixel at the intersect of the 5th column of pixels and the 3rd row of pixels, the average mura compensation value is a sum of the mura compensation values corresponding to all the pixels in the corresponding special region divided by 40.

S140: obtaining mura compensation values corresponding to other pixels except the center pixels of the special regions according to the stored mura compensation values of the special regions.

The mura compensation values corresponding to the other pixels in the special regions can be processed with reference to S122 and S123, and are not described here.

Figure 7:
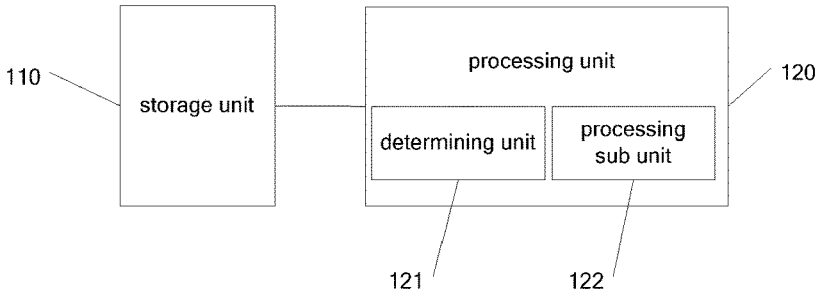
FIG. 7 is a composition diagram of a display panel according to one embodiment of the present invention.

Besides, the embodiment of the present invention further provides a display panel. Please refer to FIG. 7. The display panel comprises:

a storage unit 110, implementing compression for a region of n*m pixels to store a mura compensation value corresponding to a center pixel of each region, wherein the mura compensation value of the center pixel of at least one region is an average mura compensation value of a corresponding region, and n and m are integers larger than or equal to 2;

In this embodiment, the storage unit 110 is a data memory (flash) but the present invention is not limited thereto. In other embodiments of the present invention, the storage unit may also be a sequence controller (Tcon IC). In this embodiment, the mura compensation value corresponding to the center pixel of each region is the average mura compensation value of the corresponding region.

a processing unit 120, obtaining mura compensation values corresponding to other pixels except the center pixel according to the stored mura compensation value.

In this embodiment, the processing unit 120 is a sequence controller (Tcon IC).

Besides, in this embodiment, the processing unit specifically comprises:

a determining unit 121, determining whether the other pixels are located outside a row or a column, where an outermost center pixel of the display panel is located;

a processing sub unit 122, if a determination of the determining unit 121 is yes, taking the mura compensation value corresponding to the center pixel of the region, where the other pixels are located as the mura compensation values corresponding to the other pixels, and if the determination of the determining unit 121 is no, obtaining the mura compensation values corresponding to the other pixels by linearly interpolating the mura compensation value corresponding to the center pixel of the region, where the other pixels are located and a mura compensation value corresponding to a center pixel of an adjacent region.

Significantly, each of the embodiments in the specification is described in a progressive manner, and each embodiment focuses on the differences from other embodiments, and the same or similar parts among the various embodiments can be referred to one another. For the embodiment of the device, it is basically similar with the embodiment of method, so the description is simpler, and the related parts can be referred to the description of the embodiment of method.

With the description of the foregoing embodiment, the present invention has advantages below:

Since the mura compensation values stored in the display panel are reduced relative to the prior art, the display panel storage space can be reduced, so that the cost can be reduced.

Above are embodiments of the present invention, which does not limit the scope of the present invention. Any equivalent amendments within the spirit and principles of the embodiment described above should be covered by the protected scope of the invention.

What is claimed is:

1. A mura phenomenon compensation method of a display panel, comprising steps of:

implementing compression for a region of n*m pixels of the display panel to store a mura compensation value corresponding to a center pixel of the region of n*m pixels, wherein the mura compensation value of the center pixel of the region of n*m pixels is an average mura compensation value of the region of n*m pixels, and n and m are integers larger than or equal to 2;

obtaining mura compensation values corresponding to other pixels of the region of n*m pixels except the center pixel according to the stored mura compensation value;

wherein the step of obtaining mura compensation values corresponding to the other pixels of the region of n*m pixels except the center pixel according to the stored mura compensation value comprises:

determining whether the other pixels of the region of n*m pixels are located outside a row or a column, where an outermost center pixel of the display panel is located;

taking the mura compensation value corresponding to the center pixel of the region of n*m pixels, where the other pixels of the region of n*m pixels are located as the mura compensation values corresponding to the other pixels in case that the other pixels of the region of n*m pixels are located outside the row or the column, where the outermost center pixel of the display panel is located.

2. The mura phenomenon compensation method of the display panel according to claim 1, wherein the step of obtaining mura compensation values corresponding to the other pixels of the region of n*m pixels except the center pixel according to the stored mura compensation value further comprises:

obtaining the mura compensation values corresponding to the other pixels of the region of n*m pixels by linearly interpolating the mura compensation value corresponding to the center pixel of the region of n*m pixels, where the other pixels are located and a mura compensation value corresponding to a center pixel of a region adjacent to the region of n*m pixels in case that the other pixels are not located outside the row or the column, where the outermost center pixel of the display panel is located.

3. The mura phenomenon compensation method of the display panel according to claim 1, wherein n=m.

4. The mura phenomenon compensation method of the display panel according to claim 1, wherein the display panel comprises a plurality of special regions at edges, and the special regions comprises pixels of n*a or b*m, wherein a is less than m and a is a positive integer, and b is less than n and b is a positive integer, and the method further comprises steps of:

storing mura compensation values corresponding to center pixels of the special regions, wherein the mura compensation values corresponding to the center pixels of the special regions at edges are average compensation values of the plurality of special regions at edges;

obtaining mura compensation values corresponding to other pixels in the plurality of special regions at edges except the center pixels of the special regions at edges according to the stored mura compensation values of the special regions at edges.

5. The mura phenomenon compensation method of the display panel according to claim 1, wherein a resolution of the display panel is 3840*2160, and n=m=8, and the display panel comprises 480*270 separate regions.

6. A display panel, comprising:

a storage unit, implementing compression for a region of n*m pixels of the display panel to store a mura compensation value corresponding to a center pixel of the region of n*m pixels, wherein the mura compensation value of the center pixel of the region of n*m pixels is an average mura compensation value of the region of n*m pixels, and n and m are integers larger than or equal to 2;

a processing unit, obtaining mura compensation values corresponding to other pixels of the region of n*m pixels except the center pixel according to the stored mura compensation value;

wherein the processing unit further comprises:

a determining unit, determining whether the other pixels of the region of n*m pixels are located outside a row or a column, where an outermost center pixel of the display panel is located;

a processing sub unit, taking the mura compensation value corresponding to the center pixel of the region of n*m pixels, where the other pixels of the region of n*m pixels are located as the mura compensation values corresponding to the other pixels in case that the other pixels are located outside the row or the column, where the outermost center pixel of the display panel is located; obtaining the mura compensation values corresponding to the other pixels of the region of n*m pixels by linearly interpolating the mura compensation value corresponding to the center pixel of the region of n*m pixels, where the other pixels are located and a mura compensation value corresponding to a center pixel of a region adjacent to the region of n*m pixels in case that the other pixels of the region of n*m pixels are not located outside the row or the column, where the outermost center pixel of the display panel is located.

* * * * *